US006889846B2

(12) United States Patent
Olsen et al.

(10) Patent No.: US 6,889,846 B2
(45) Date of Patent: May 10, 2005

(54) HYBRID SCREEN

(75) Inventors: Lawrence C. Olsen, Jasper, OR (US); Bob Stafford, Mequon, WI (US); Kevin Prociw, Springfield, OR (US)

(73) Assignee: Johnson Crushers International, Eugene, OR (US)

( * ) Notice: Subject to any disclaimer, the term of this patent is extended or adjusted under 35 U.S.C. 154(b) by 386 days.

(21) Appl. No.: 10/099,511

(22) Filed: Mar. 15, 2002

(65) Prior Publication Data

US 2003/0173257 A1 Sep. 18, 2003

(51) Int. Cl.[7] ..... B07B 1/49

(52) U.S. Cl. ..... 209/404; 209/309; 209/311; 209/319

(58) Field of Search ..... 209/404, 309, 209/311, 313, 314, 315, 319

(56) References Cited

U.S. PATENT DOCUMENTS 6,367,633 B1 * 4/2002 Douglas ..... 209/311

* cited by examiner

*Primary Examiner*—Donald P. Walsh
*Assistant Examiner*—Jonathan R Miller
(74) *Attorney, Agent, or Firm*—Schwabe, Williamson & Wyatt

(57) ABSTRACT

A hybrid incline/horizontal screen for separating particulate material into predetermined size fractions, the screen having multiple screen decks mounted on a frame, at least one uppermost screen deck having an inclined receiving end and a horizontal discharge end. Each screen deck has a screening medium with predetermined sized openings that screens the particulate material. The screen decks are in stacked relationship, the upper screen deck having the largest screen medium openings, the openings becoming progressively smaller the lower the screen deck is mounted on the frame. The inclined receiving portion of the one or more uppermost screen decks provides for rapid material separation and conveyance through the upper screen decks to the lower screen decks while the horizontal discharge end reduces the tendency for the material to pile up (snowball) and maintaining a more uniform material bed, while providing for a shorter, more transportable screen. The screen incorporates perforated and non-perforated feed boxes at the screen deck receiving end to protect the screen decks from dropping material impact loads, to provide for an extended screening surface, and to pre-distribute the material as it falls into the feed box.

19 Claims, 4 Drawing Sheets

HYBRID SCREEN

FIELD OF THE INVENTION

This invention relates to a screen for separating rock material, and more particularly to a modified inclined vibrating screen that enhances the screens ability to receive and process material to be screened.

BACKGROUND OF INVENTION

Screens are used in the aggregate business for separating rock, crushed rock, gravel, sand, and the like (referred herein as material) into various component sizes, referred to as size fractions. Screens comprise one or more screen decks containing a perforated screening medium which acts as a sieve through which the material is separated. A charge of material is deposited on the receiving end of the screen, and as the material is conveyed to the discharge end, smaller material falls through the openings leaving the larger material behind.

In a common application in the production of gravel, such as for road building, at the quarry site, a charge of material is crushed using a rock crusher. The crushed material is then conveyed to the screen for separating. In an example of the use of a three-deck screen, material is separated into four sizes: large, medium, small, and smallest. The larger material is retained on the upper screen deck and conveyed off of the screen deck at the upper discharge end, the medium-sized material is retained on the middle screen deck and conveyed off of the screen deck at the middle discharge end, the smaller size material is retained on the lower screen deck and conveyed off of the screen deck at the lower discharge end, and the smallest material is deposited below the lower screen deck. The larger material, if too large for a particular purpose, may be collected from the screen and reprocessed by the crusher and re-screened until the desired size is obtained. Screens are commonly very large machines that are capable of continuously separating large quantities of material, hundreds of tons per hour, as part of the quarry operation.

There are various types of screens loosely classified by the configuration of the screen deck and the method used to pass the material through the screening medium. One common method to pass the material through the screening medium is to submit the screen deck to vibratory motion to agitate and expose the material to the screening medium surface. The screens have a front or receiving end that receives the mixed material and a back or discharge end that discharges the separated material.

The screen deck generally consists of a rigid frame upon which a screening medium is laid or supported. The screening medium contains a plurality of openings of a predetermined size. Examples of screening medium include woven wire cloth and perforated plate. Material is placed upon the screening medium and material that is smaller than the predetermined size falls through the openings in the screening medium, and thus separates the smaller material from the larger material. The material that is larger than the predetermined size of the openings is subsequently removed from the screen deck, and commonly made to move across the screen deck to be discharged at a location separate from the smaller material. The capability of the screen to convey the material in combination with screening allows for continuous material processing.

Screens come in two basic screen deck configurations; inclined and horizontal. Inclined screens have one or more screen decks with an elevated receiving end with respect to the discharge end. Material is placed on the higher end of the screen deck, and as the material moves down the inclined screen deck to the discharge end, the smaller material passes through the openings of the screening medium. The larger material is discharged from the screen deck at the discharge end.

The movement of material down the screen deck is provided by gravity, or, more commonly, in combination with the assistance of a vibrating mechanism. The vibrating mechanism is not only used to assist gravity, but also to agitate the material to more efficiently present the smaller material to the screening medium.

Quarry-sized inclined screens are very tall machines. Being such tall machines, inclined screens are difficult to transport from quarry to quarry. When transportation is required, inclined screens are commonly disassembled and broken down requiring significant labor and time for both disassembly and re-assembly.

Horizontal screens are configured such that the screen deck is level or horizontal. Horizontal screens are normally selected when there is a need to maintain a lower profile, such as for use in confined spaces or for transportation/mobility considerations. Horizontal screens require the use of a vibrating mechanism to agitate the material for effective separation. The vibrating mechanism is configured in its construction and operation to not only agitate the material, but also convey the material from the receiving end to the discharge end in screens having a continuous material processing capability. Horizontal screens require significantly more powerful and aggressive vibrating mechanisms to agitate and convey the material along the screen deck as compared with the inclined screen.

It is common that screens utilize a plurality of screen decks in a stacked arrangement, one above the other, to separate the material into multiple sizes. In the case of a three-deck screen with an upper, middle and lower screen deck, the upper screen deck comprises the largest openings, the middle screen deck comprises smaller openings, and the lower screen deck comprises the smallest openings. As the material traverses the upper screen deck, the larger material remains on the upper screen deck while the smaller material falls to the middle screen deck. The middle screen deck with the smaller openings contains the medium sized material while allowing the passage of smaller material to the lower screen deck. The lower screen deck with the smallest openings contains the smaller material while allowing the smallest material, such as dust or fines, to pass through. As the separated material is conveyed along its respective screen deck to the discharge end, it is deposited into four separate areas for collection; large, medium, small, and smallest material size fractions. The three-deck screen, therefore, is capable of separating material into four material size fractions.

In operation, the multiple-deck screen will deposit material onto the underlying screen decks at different rates and locations. For example, the material that passes through the upper screen deck will fall to the middle screen deck somewhat down-line from the receiving end of the upper screen deck. In like fashion, the material that passes through the middle screen deck will fall to the lower screen deck somewhat further down-line from the receiving end of the upper screen deck. The delay in dropping the material through the screen decks is due to the fact that the particles must transcend down through the layer of material, referred to as the material bed, on one screen deck before it can drop through to the screen deck below. Therefore, the length of the screen depends on the number of screen decks and the relative speed that the material passes through each subsequent screen deck.

It is common for screens to utilize a vibrating mechanism to assist in the separation process as well as in the conveyance of the material towards the discharge end. The one or more screen decks are coupled together to a common rigid frame. The assembly comprising the multiple screen decks and the common frame is known as the screen box. The screen box is vibrated by a vibrating mechanism that is coupled to the common frame. Therefore, one vibrating mechanism vibrates all the screen decks simultaneously. The vibratory motions promote stratification in the material bed, bringing the smaller material down to the screening medium surface to be passed through the openings.

The common types of vibrating mechanisms can be characterized by the form of the vibration and the number of bearings used in the mechanism. A two bearing, circle throw, inclined screen utilizes a counter weight on a shaft to vibrate the screen box, and therefore the screen decks, in a desired motion. Common vibrating mechanisms produce motions that include circular, elliptic and straight-line reciprocating movement. The motion can be directed to propel the material toward the discharge end to help convey the material in that direction. The screen box is isolated from the ground or support structure by springs or other damping apparatus.

Separation efficiency is determined in part by the operating parameters of the vibrating mechanism. Those parameters include frequency, amplitude, attack angle and travel velocity imparted on the material. For a given material size distribution, weight, shape and quantity, as well as size of the openings, an optimum set of parameters can be determined for a given screen deck. Since a common vibrating mechanism is used to vibrate all of the screen decks simultaneously, the parameters set on the vibrating mechanism for multi-deck screens will be a compromise of efficiency for any one particular screen deck.

The efficiency of operation of screens is determined in part by the power required to separate a given quantity of material. The power to operate an inclined screen includes the power to lift the material to the height of the receiving end of the screen, as well as the power used to move the material across the screen decks. Inclined screens take advantage of gravity to convey the material towards the discharge end. In contrast, the horizontal screen power requirement is potentially less to load the material onto the receiving end, but is significantly more to move the material along the screen deck.

The screening medium surface is the most life-limited part of a screen. The screening medium surface must be strong enough to withstand the initial impact of the bulk material onto the receiving end of the screen deck as well as the material falling on the lower screen decks. The screening medium surface must also support the weight of the material and be flexible enough to withstand the vibration. Additionally, the screening medium must provide enough open area to allow the desired throughput of material while preventing the openings from becoming clogged.

The above mentioned vibrating screens have a number of drawbacks. Regarding the inclined screens, the height of the screen is a significant hindrance for moving the screen from place to place. Most particularly, the inclined screens require disassembly in order to move them along improved roadways with overhead obstructions requiring significant labor and time.

Inclined screens are known to cause a "snowball" effect as the material is conveyed down the screen decks. That is, material placed on the receiving end of the screen deck is at first conveyed slowly down the screen deck but increases in speed and momentum sufficient to overcome the preceding material. This causes a piling up of material increasing the material bed depth. As the material bed depth increases, separation efficiency decreases as it takes longer for the smaller material to transcend the material bed and make contact with the screening medium surface.

Horizontal screens are more readily transportable but require considerable power to operate and move the material through the machine. Further, horizontal screens are limited to the number of screen decks, commonly three, that can be used. This is due to the length of screen deck required to pass the material through each subsequent screen deck, in part caused by the delay in material dropping from the screen decks above.

An improved screen is needed that incorporates the reduced height of a horizontal screen for improved transportability and reduced power requirements in lifting the material to the receiving end, with the power efficiencies of the inclined screen, while keeping the overall length of the screen to a minimum and decreasing the detrimental effects of the "snowball" effect. Improvements are also needed to increase the lifetime of the screening medium, particularly to reduce the damage caused by the initial impact loads of the material dropping onto the screen decks.

SUMMARY OF INVENTION

In an embodiment of the screen in accordance with the present invention, a screen is provided with one or more upper screen decks having a hybrid configuration consisting of an inclined receiving end transitioning into a horizontal discharge end. Each screen deck having an inclined portion is segmented into a plurality of sections with each adjacent section being inclined at a decreasing angle with the distance away from the receiving end. The uppermost screen decks have receiving portions having a greater incline angle which progressively decreases from higher to lower screen decks. The inclined portion of the screen decks provides for rapid material separation through the screening medium and faster conveyance close to the receiving portion. The decreasing inclination angle with down-line distance from the receiving end provides a more uniform and consistent material bed depth, effectively preventing the "snowball" effect of constant inclined screen decks.

In addition, the hybrid incline/horizontal screen optimizes the benefits of the inclined screens with the benefits of the horizontal screens to produce a screen providing improved energy efficiencies as well as a shorter, more easily transportable screen.

The hybrid screen allows for adjustment of a number of screen deck parameters, such as: the inclination angle of any of the individual feed box and screen sections, the number of screen sections per screen deck that is inclined, the same or different inclination angles between adjacent screen sections, the number of screen decks used, the total number of screen sections used per screen deck, the length and width of the screen sections, and whether or not a feed box, with or without openings is used.

Therefore, a hybrid inclined/horizontal screen is within the scope of the present invention having one or more screen decks having one or more sections of each screen deck inclined at an inclined angle from horizontal. The inclination angle of the sections of each screen deck is reduced with down-line distance from the receiving end of the screen. A hybrid screen also within the scope of the invention consists of the hybrid screen as described that utilizes a vibrating mechanism to assist in the conveyance and separation of the material being separated.

It is further anticipated that the screen is configurable to accommodate for changing the screen deck parameters without undue modification to the screen frame. For example, in an embodiment of the invention, the frame will accommodate attachment apparatus to adjust the inclination angle of any given screen deck section, without replacement of frame parts or rework of the frame itself.

A feed box is presented for coupling with the receiving end of the uppermost and lower screen decks, that provides for impact protection for the screening medium as well as an extended screening surface. The feed box is provided with a base plate having openings of a predetermined size to correspond with the openings of the corresponding screen deck medium. The feed box plate can be configured to be more capable of resisting the impact loads of the dropped material, while assisting in the distribution of the material bed prior to conveyance onto the screen deck medium.

It is appreciated that the invention of the screen may be practiced without the inclusion of the upper and middle feed boxes, and, as such, is within the scope of the invention. It is further appreciated that the upper and lower feed boxes are advantageously used on conventional horizontal and inclined screens to protect the screen medium, to provide for an extended screening surface, and to pre-distribute the material as it falls into the feed box, and as such, is within the scope of the invention.

The invention and its advantages will be further appreciated upon reference to the following detailed description and the accompanying drawings.

DESCRIPTION

In the following detailed description, reference is made to the accompanying drawings which form a part hereof wherein like numerals designate like parts throughout, and in which is shown by way of illustration specific embodiments in which the invention may be practiced. An embodiment of a screen having three screen decks is presented. It is to be understood that other embodiments may be utilized and structural or logical changes may be made without departing from the scope of the present invention; including, but not limited to, a screen having one or more screen decks and having either no vibrating mechanism or any of a variety of vibrating mechanisms known in the art. Therefore, the following detailed description is not to be taken in a limiting sense, and the scope of the present invention is defined by the appended claims and their equivalents.

Figure 1:
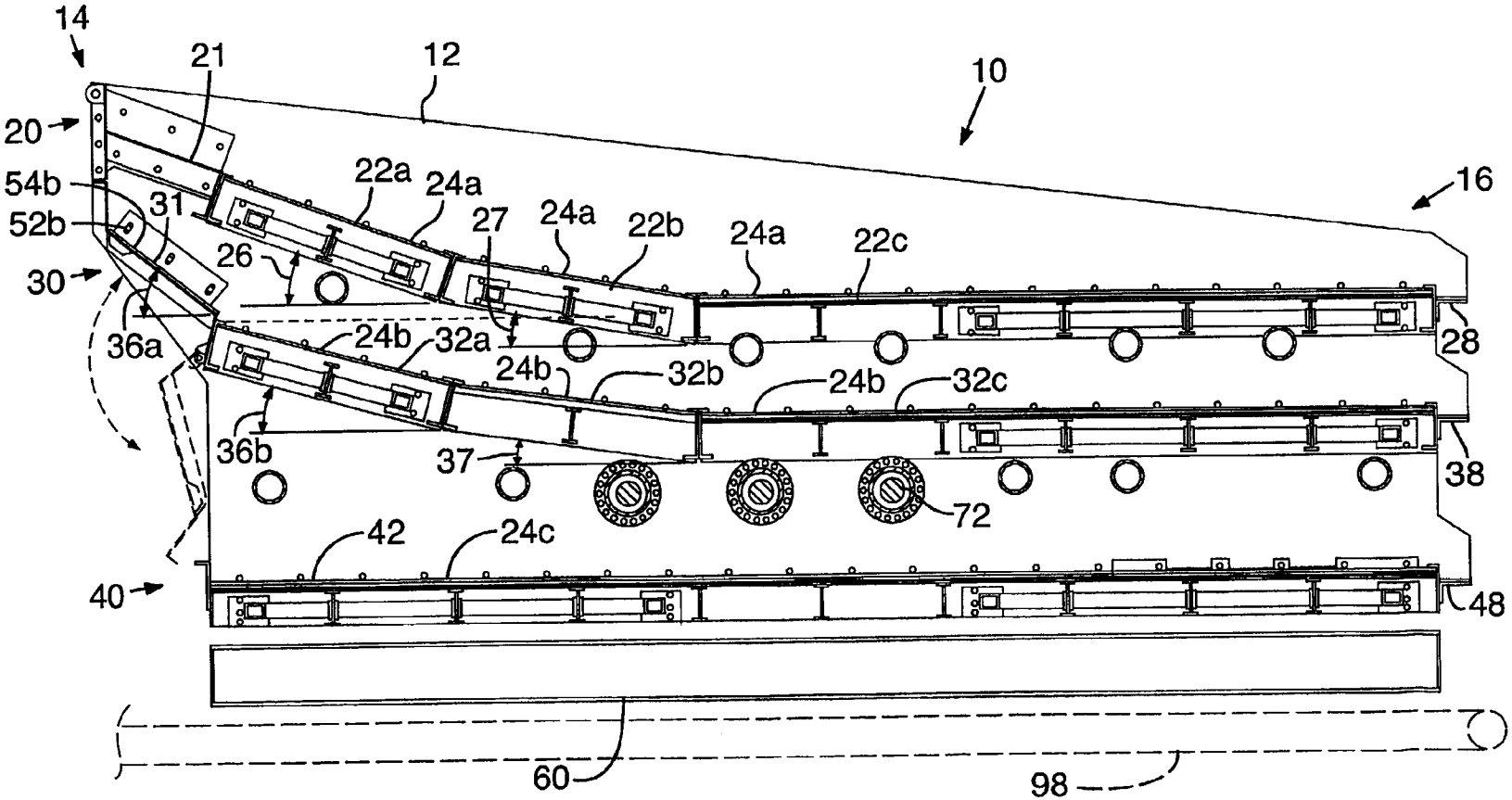
FIG. 1 is a partial cut-away side view of a screen in accordance with an embodiment of the present invention.
Figure 2:
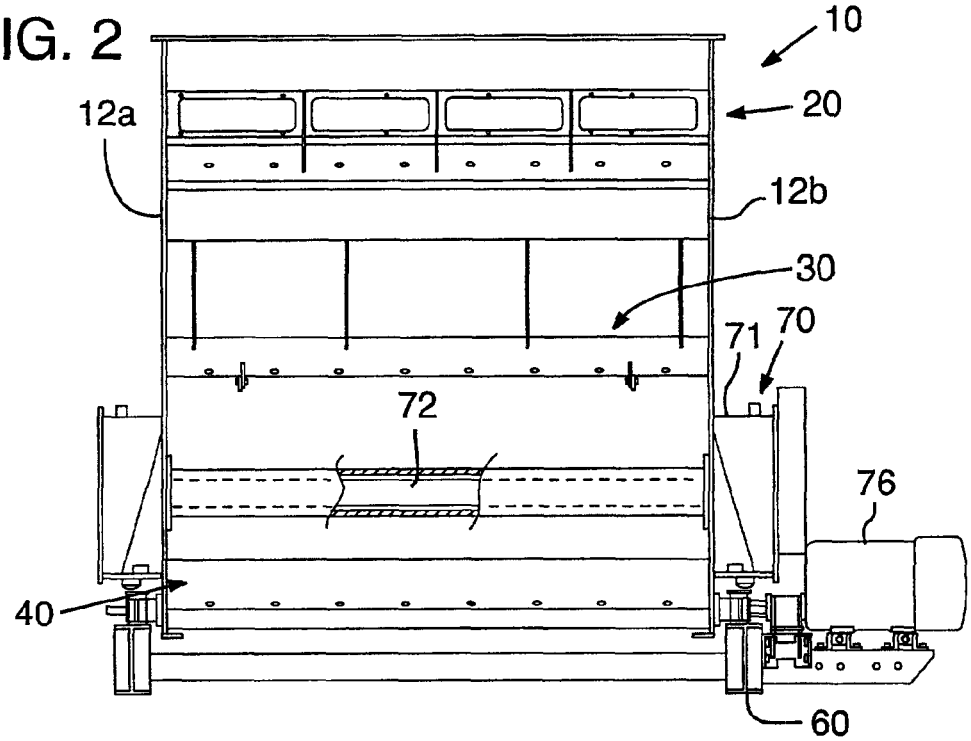
FIG. 2 is an end view of the screen of FIG. 1.

FIGS. 1 and 2 illustrate a screen 10 arranged to separate particulate material, such as crushed rock, gravel, sand, and the like (referred herein as material) into various component sizes, referred to as size fractions. The screen 10 comprises a frame 12 having a first side wall 12*a* and a second side wall 12*b* spaced apart from the first side wall 12*a*. An upper screen deck 20 extends between the first and second side walls 12*a,b*. In addition, a bottom screen deck 40 extends between the first and second side walls 12*a,b* of the frame 12, below the upper screen deck 20. Between the upper screen deck 20 and the bottom screen deck 40 is a middle screen deck 30 also extending between the first and second side walls 12*a,b*. The screen 10 has an inlet end 14 for receiving mixed material and a discharge end 16 for discharging separated material.

Figure 3:
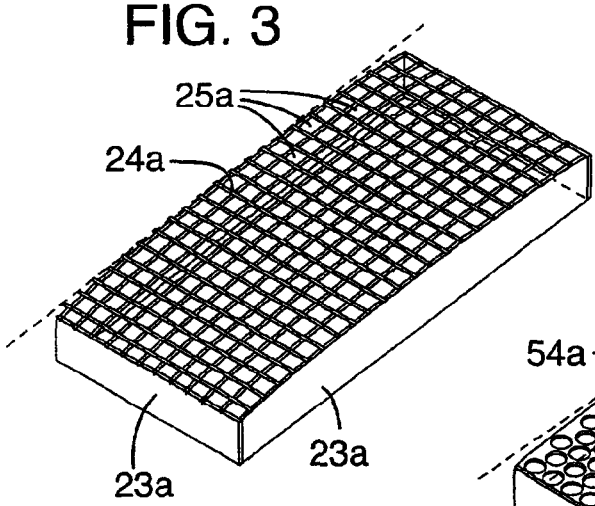
FIG. 3 is a perspective view of a screen section in accordance with the embodiment of FIG. 1.
Figure 4:
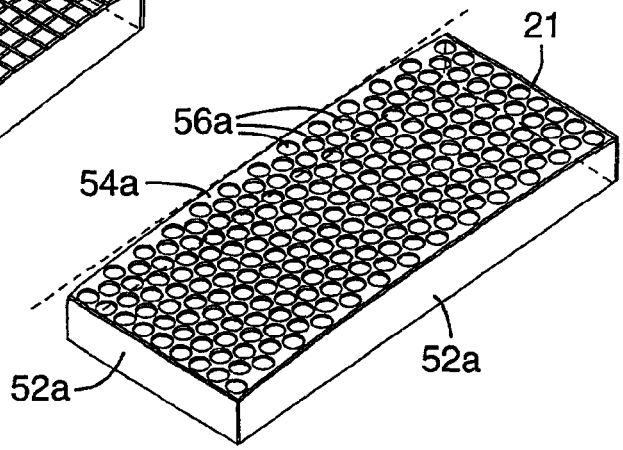
FIG. 4 is a perspective view of a feed box in accordance with the embodiment of FIG. 1.

The upper screen deck 20 comprises an upper feed box 21 and three upper screen sections 22*a–c,* each proximate to or coupled end to end. The upper feed box 21 is arranged strategic to the screen inlet end 14. Each upper screen section 22*a–c* comprises screening medium 24*a* supported by a frame 23*a,* as shown in FIG. 3. The screening medium 24*a* is formed to include a plurality of openings 25*a* therein to permit pieces of particulate matter smaller than the openings 25*a* to fall through the screening medium 24*a*. The screening medium 24*a* can be of a variety of configurations, including, but not limited to, woven wire cloth and perforated plate.

The upper feed box 21 and the first upper screen section 22*a* is coupled to the frame 12 at a first angle 26 to the horizontal. The first angle 26 is determined in consideration of the material to be separated, as will be discussed below. In the embodiment shown in FIG. 1, the first angle 26 is 20 degrees. The second upper screen section 22*b* is proximate to or coupled to the first upper screen section 22*a* and coupled to the frame 12 at a second angle 27. Second angle 27 is more shallow than the first angle 26 of the first upper screen section 22*a*. In the embodiment shown in FIG. 1, the second angle 27 is 10 degrees. The third upper screen section 22*c* is coupled to the frame 12 in a horizontal orientation, with the third upper screen section 22*c* proximate to or coupled to the second upper screen section 22*b*. An upper discharge chute 28 is coupled to the frame 12 proximal to the third upper screen section 22*c* such that the separated material is conveyed from the third upper screen section 22*c* to the upper discharge chute 28.

The middle screen deck 30 is arranged in similar fashion as the upper screen deck 20. The middle screen deck 30 comprises a middle feed box 31 and three middle screen sections 32*a–c,* each proximate to or coupled end to end. The middle feed box 31 is coupled to the frame 12 at a third angle 36*a* to the horizontal. The third angle 36*a* is greater than the first angle 26 of the upper feed box 21 and the first upper screen section 22*a*. The first middle screen section 32*a* is coupled to the frame 12 at a fourth angle 36*b* to the horizontal, the fourth angle 36*b* being more shallow than the first angle 26 of the upper feed box 21 and the first upper screen section 22*a*. In the embodiment shown in FIG. 1, the third angle 36*a* is 45 degrees and the fourth angle 36*b* is 15 degrees. The second middle screen section 32*b* is proximate to or coupled to the first middle screen section 32*a* and coupled to the frame 12 at a fifth angle 37. The fifth angle 37 is more shallow than the fourth angle 36*b* of the first screen section 32*a,* and likewise, at a more shallow angle than the second upper screen section 22*b*. In the embodiment shown in FIG. 1, the fifth angle 37 is 7.5 degrees. The third middle screen section 32*c* is coupled to the frame 12 in a horizontal orientation, with the third middle screen section 32*c* proximate to or coupled to the second middle screen section 32*b*. A middle discharge chute 38 is coupled to the frame 12 proximal the third middle screen section 32*c* such that the separated material is conveyed from the third middle screen section 32*c* to the middle discharge chute 38.

The lower screen deck 40 comprises one lower screen section 42. The bottom screen deck 40 is arranged in a horizontal orientation and parallel with the third upper and middle screen sections 22*c*,32*c* of the upper and middle screen decks 20,30, respectively. A lower discharge chute 48 is coupled to the frame 12 below the lower screen section 42 such that the separated material is conveyed from the lower screen section 42 to the lower discharge chute 48.

The upper and middle feed boxes 21,31 are arranged in substantial vertical alignment with each other. Likewise, the first upper and middle screen sections 22*a*,32*a* are in substantial vertical alignment with each other, the second upper and middle screen sections 22*b*,32*b* are in substantial vertical alignment, and the third upper and middle screen sections 22*c*,32*c* are in substantial vertical alignment. The upper, middle, and lower screen decks 20,30,40 are in substantial vertical alignment with each other.

The upper, middle and lower screening medium 24*a–c* of the upper, middle and lower screen sections 22*a–c*,32*a–c*, 42, respectively, is formed to include a plurality of openings 25*a–c* therein to permit particulate matter smaller than the openings 25*a–c* to fall through the respective screen decks 22,32,42. In one embodiment in accordance with the invention, the upper screening medium 24*a* in each of the upper screen sections 22*a–c* comprise the same size openings 25*a*. Likewise, the middle screening medium 24*b* in each of the middle screen sections 32*a–c* comprise the same size openings 25*b*, and the lower screening medium 24*c* in the bottom screen section 42 comprises the same size openings 25*c*. The upper screen openings 25*a* are larger than the middle screen openings 25*b*. And likewise, the middle screen openings 25*b* are larger than the lower screen openings 25*c*.

In another embodiment in accordance with the invention, the screening medium 24*a–c* on each screen deck 22,32,42 has screen openings 24*a–c* that either increase or decrease in size along the length of each screen deck 22,32,42. For particular applications, screening operation efficiencies can be improved wherein each screen deck 22,32,42 has screen openings 24*a–c* of decreasing size from the first screen section 22*a*,32*a*,42*a* to the third screen section 22*c*,32*c*,42*c*. For example, the screening medium 24*a* of the first upper screen section 22*a* comprises larger openings 25*a* than the screening medium 24*a* of the second upper screen section 22*b*, which, in turn, has larger screen openings 25*a* than the screening medium 24*a* of the third upper screen section 22*c*. Such a configuration is used in situations wherein a more rapid screening of material is desired with the use of oversized screen openings 25*a–c* in one or more of the first screen sections 22*a*,32*a*,42*a*, and it is acceptable that some oversized material passes to the screen deck below.

Similarly, for particular applications, screening operation efficiencies can be improved wherein each screen deck 22,32,42 has screen openings 24*a–c* of increasing size from the first screen section 22*a*,32*a*,42*a* to the third screen section 22*c*,32*c*,42*c*. For example, the screening medium 24*a* of the first upper screen section 22*a* comprises smaller openings 25*a* than the screening medium 24*a* of the second upper screen section 22*b*, which, in turn, has smaller screen openings 25*a* than the screening medium 24*a* of the third upper screen section 22*c*. Such a configuration is used in situations wherein it is desired to produce a more even material bed depth by delaying the screening of material of a certain size until the material reaches a desired location down-line.

Screening medium having different size openings on each of the screen decks, in any combination, is within the scope of the invention.

The upper and middle feed boxes 21,31 are used primarily to protect the screen decks 20,30 from the impact of the received material. The upper feed box 21 comprises a upper feed box frame 52*a* lined with a rigid perforated plate 54*a*. The perforated plate 54*a* comprises a plurality of openings 56 sized to correspond with the upper screen openings 25*a* of the upper screen sections 22*a–c*. The upper feed box 21 serves as the receiving end 14 of the screen 10. Material is dropped into the upper feed box 21 rather than directly onto the first upper screen section 22*a*, therefore protecting and prolonging the life of the screening medium 24*a* in the first upper screen section 22*a*. The upper feed box 21 also helps in distributing the material widthwise prior to entering the first upper screen section 22*a* for more effective screening, as the material bed will be more uniform across the width of the upper screen sections 22*a–c* and the screen decks 30,40 below.

The upper feed box 21 additionally provides an extension to the effective screening area of the upper screen deck 20. Material small enough to pass through the openings 56, will fall into the middle feed box 31. Middle feed box 31 comprises a middle feed section frame 52*b* with a solid bottom plate 54*b*. The middle feed box 31 helps to protect the first middle screen section 32*a* from the impact of the material dropping down from the upper feed box 21, serving to prolong the life of the screening medium 24*b*.

Figure 5:
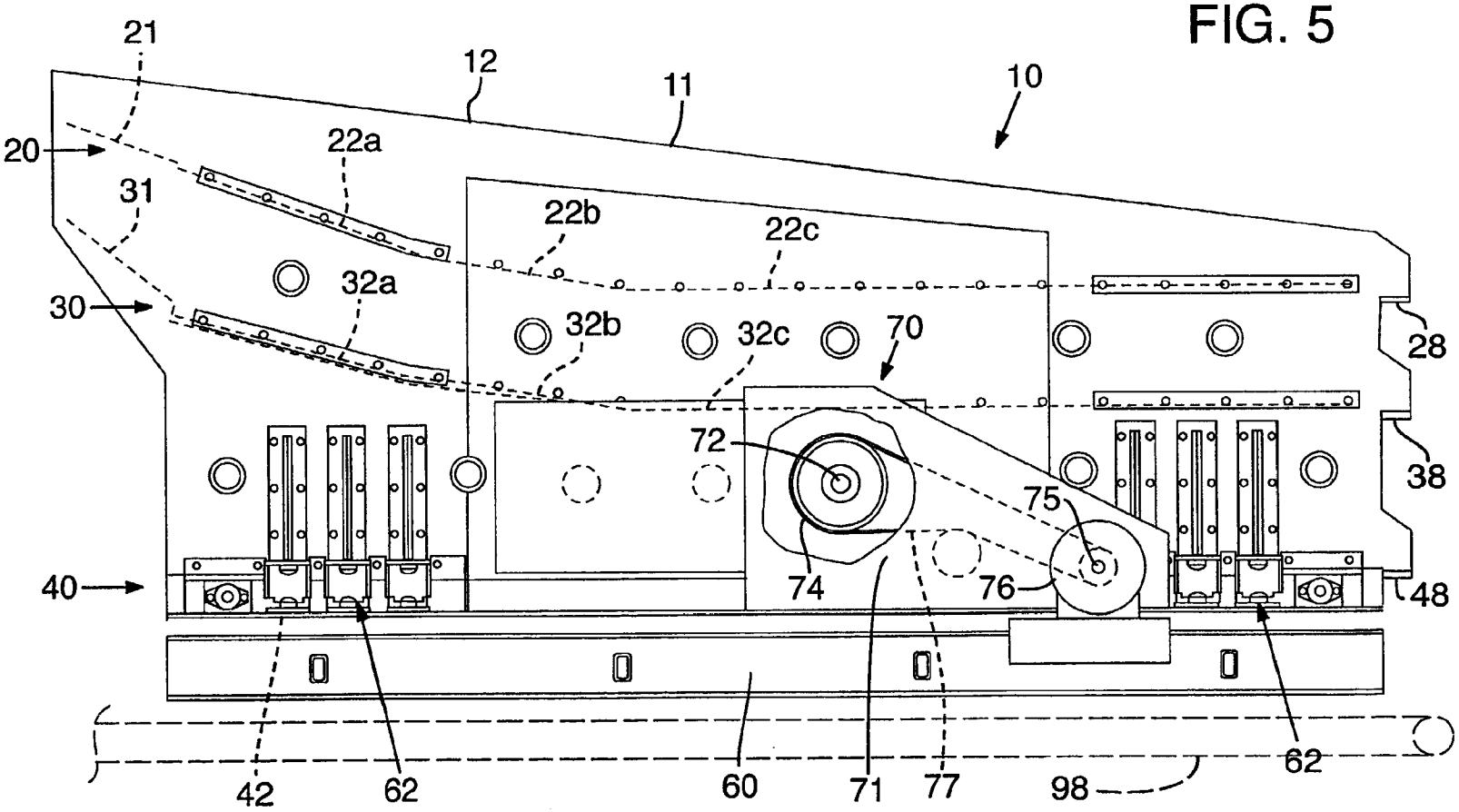
FIG. 5 is a side partial cut-away view of the screen in accordance with the embodiment of FIG. 1.

FIG. 5 is a side partial cut-away view of the screen in accordance with the embodiment of FIG. 1. The frame 12 is coupled to a stationary chassis 60 by spring mount assemblies 62. The spring mount assemblies 62 isolate the frame 12 from the chassis 60.

A vibrating mechanism 70 is used to impart vibratory motion to the frame 12 and thus to the upper, middle and lower screen decks 20,30,40. The assembly of the frame 12 and the screen decks 20,30,40 is referred to as the screen box 11. Vibrations from the vibrating mechanism 70 is used to agitate and convey the material along the upper, middle and lower screen decks 20,30,40 towards the discharge chutes 28,38,48. Any of a variety of types of vibrating mechanisms 70 can be employed to impart motion to the screen box 11. One type of vibrating mechanism 70, shown in FIGS. 2 and 5, comprises a drive shaft 72 located within a housing 71 of the vibrating mechanism 70. A drive wheel 74 is coupled to the drive shaft 72. A motor drive shaft 75 of a motor 76 is coupled to the drive wheel 74 by a drive belt 77 to rotate the drive shaft 72. Counterweights (not shown) are coupled to the drive shaft 72. Rotation of drive shaft 72 causes rotation of counterweights (not shown) which vibrates the screen box 11.

Figure 6:
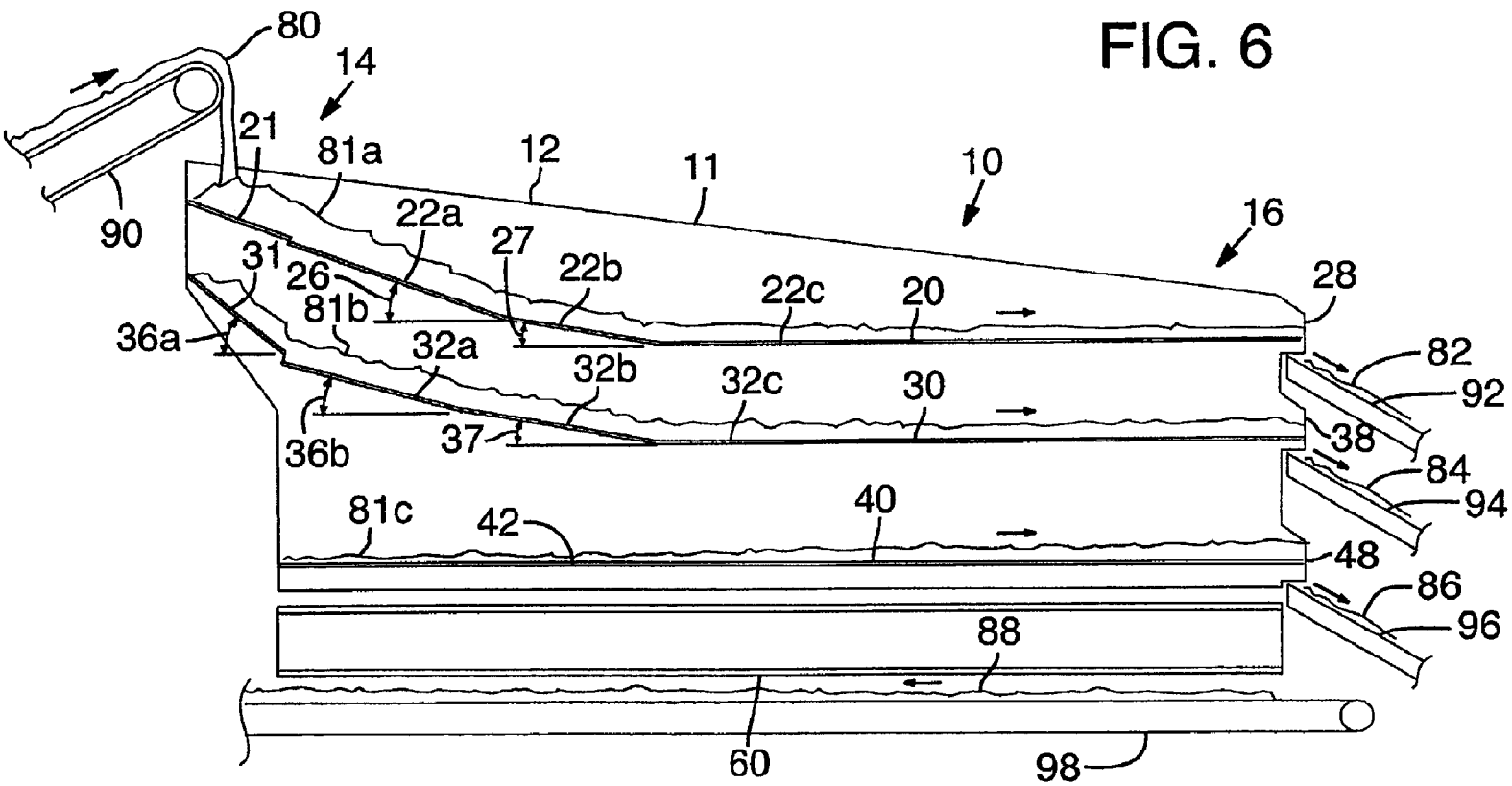
FIG. 6 is a simplified cut-away view of the screen in accordance with the embodiment of FIG. 1 illustrating a method for using the screen.

FIG. 6 is a simplified cut-away view of the screen in accordance with the embodiment of FIG. 1 illustrating a method for using the screen. The screen 10 separates mixed material 80 into four size fractions: large 82, medium 84, small 86, and smallest 88. As the vibrating mechanism 70 is engaged, a charge of mixed material 80 is deposited in the receiving end 14 which is coincident with the upper feed box 21. The mixed material 80 passes over the perforated plate 54*a* of the upper feed box 21 and onto the upper screen sections 22*a–c*, becoming distributed over the width of the screen deck 20 as a material bed 81*a*. As the material bed 81*a* passes over the upper screen deck 20, medium, smaller and smallest material 84,86,88 passes through the upper screen sections 22*a–c*. The medium, smaller and smallest material 84,86,88 is deposited onto the middle screen deck 30 forming middle material bed 81*b*. The remaining larger material 82 is conveyed to the discharge end 16 and out of the upper discharge chute 28 and conveyed away by collection chute 92. In similar fashion, the middle and small material bed 81*b,c* traverses the middle and lower screen decks 30,40, respectively, while the separated middle and small material 84,86 is discharged out of the middle and lower discharge chutes 38,48, respectively and conveyed away by collection chutes 94,96. The smallest material 88 falls through the lower screen section 40 and is taken away on a conveyor 98.

The screen 10 of FIG. 1 combines the benefits of an inclined screen with the benefits of a horizontal screen. The upper and middle feed boxes 21,31 and the upper and middle first and second screen sections 22*a–b*,32*a–b* are inclined from the horizontal which provides a number of benefits. The material will be conveyed down the inclined surfaces faster than if the surfaces were horizontal which helps to prevent material pileup near the receiving end of the screen. Additionally, smaller material will pass more quickly through the upper, middle and lower screen decks 20,30,40 due to the tumbling action of the material down the inclined surfaces. The "snowball" effect is substantially reduced due to the combination of faster material separation and the decreasing inclination down-line from the receiving end. The combination of faster conveyance and faster separation provides a more uniform material bed along each of the screen decks 20,30,40.

The upper screen deck 20 is required to process all of the material 80 and therefore handle the greatest amount of material 80 as compared with the middle and lower screen decks 30,40. As the material 80 is received onto the upper screen deck 20, the steeper inclination angle 26 of the upper feed box 21 and first screen section 22*a* causes the material to rapidly move forward towards the third screen section 22*c* which is the horizontal portion of the upper screen deck 20. This rapid movement of the material prevents the material from accumulating or piling up at the receiving end 14. The inclination angle 27 of the second upper screen section 22*b* as compared with first upper screen section 22*a* is less to account for the decreased quantity of material being conveyed as the smaller material falls to the lower screen decks 30,40, as well as to decrease the speed of conveyance to prevent the "snowball" effect.

The smaller material passes through the upper screen deck 20 onto the middle screen deck 30. For similar reasons stated above, the middle feed box 31 and the first middle screen section 32*a* has a higher inclination angle than the second middle screen section 32*b*. Further, the middle feed box 31 and first middle screen section 32*a* has a lower inclination angle than the upper feed box 21 and first upper screen section 22*a* as there is less material being deposited on the middle screen deck 30 as compared with the upper screen deck 20.

The lower screen deck 40 has a horizontal orientation owing to the fact that the lower screen deck 40 processes an even lesser amount of material as the upper and middle screen decks 20,31 and therefore does not require the inclination for rapid material separation.

Therefore, large particles 82 are carried by the upper screen deck 20 and are discharged at the upper discharge chute 28. Medium size particles 84 fall through the upper screen deck 20 and are carried by the middle screen deck 30 and are discharged at the middle discharge chute 38. Small particles 86 pass through both the upper and middle screen decks 20,30 and are carried by the lower screen deck 40 and are discharged at the lower discharge chute 48. Very small size particles 88 fall through the lower screen deck 40 to be deposited below the screen 10.

Since the inclination of the screen decks 20,30 for the most part dictates the overall height of the screen 10, a trade-off of the benefits of the inclination with the benefits of the reduced height must be considered. Further, for a given specific need for the use of the screen 10, it may be beneficial to tailor and adjust the screen decks 20,30,40 for efficient material separation.

A number of screen deck parameters may be adjusted, such as: the inclination angle of any of the individual feed box and screen sections, the number of screen sections per screen deck that is inclined, the same or different inclination angles between adjacent screen sections, the number of screen decks used, the total number of screen sections used per screen deck, the length and width of the screen sections, and whether or not a feed box, with or without openings, is used.

Therefore, a hybrid inclined/horizontal screen is within the scope of the present invention having one or more screen decks having one or more sections of each screen deck inclined at an inclined angle from horizontal. The inclination angle of the sections of each screen deck will generally decline with the down-line distance from the receiving end of the screen. A hybrid screen also within the scope of the invention consists of a hybrid screen as described that utilizes a vibrating mechanism to assist in the conveyance and separation of the material being separated.

It is further anticipated that a frame 10 can be configured to accommodate for changing the screen deck parameters without undue modification to the frame 10. For example, in an embodiment of the invention, the frame 10 will accommodate attachment apparatus (not shown) to adjust the inclination angle of any given screen deck section, without replacement of frame parts or rework of the frame 10 itself. In one embodiment, each screen section comprises spring-loaded pins (not shown) which are inserted into corresponding apertures (not shown) of the frame 10, removably coupling the screen section to the frame 10. A series of apertures for each spring-loaded pin is provided on the frame 10, such that the inclination angle of the screen section can be adjusted by removing the pin from one aperture and receiving it within another aperture corresponding to the desired inclination angle.

It is appreciated that the invention of a screen may be practiced without the inclusion of the upper and middle feed boxes, and as such, is within the scope of the invention.

It is further appreciated that the upper and middle feed box is advantageously used on conventional horizontal and inclined screens to protect the screen medium, to provide for an extended screening surface, and to pre-distribute the material as it falls into the feed box, and as such, is within the scope of the invention.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

What is claimed is:

1. A screen for separating particulate material comprising:

a screen box;

a top screen deck having a top receiving end and a top discharge end, the top screen deck comprising two or more top screen sections having openings of a predetermined size for the separation, of particulate material there through, the two or more top screen sections mounted in the screen box and forming a substantially continuous screening surface extending from the top receiving end to the top discharge end, at least one top screen section proximate the top receiving end inclined at an angle to and extending upward and away from the other top screen sections, at least one of the other top screen sections proximate the top discharge end oriented substantially horizontally; and a vibrating mechanism coupled to the screen box to impart a common vibratory movement to the screen sections.

2. The screen as defined in claim 1, further comprising a middle screen deck having a middle receiving end and a middle discharge end, the middle screen deck comprising two or more middle screen sections having openings of a predetermined size smaller than that of the top screen deck for the separation of smaller particulate material there through, the two or more middle screen sections mounted in the screen box and forming a substantially continuous screening surface extending from the middle receiving end to the middle discharge end, the top and middle screen decks coupled to the screen box in spaced apart relationship, the middle screen deck positioned below the top screen deck, the top receiving end and top discharge end in substantial vertical alignment with the middle receiving end and the middle discharge end, respectively, at least one middle screen section proximate the middle receiving end inclined at an angle to and extending upward and away from the other middle screen sections, at least one of the other middle screen sections proximate the middle discharge end oriented substantially horizontally.

3. The screen as defined in claim 2, wherein one or more top and middle screen sections being adjustable to a predetermined inclined position.

4. The screen as defined in claim 2, wherein the at least one inclined top screen section has an inclination angle equal to or greater than the corresponding middle screen section directly below the at least one inclined top screen section.

5. The screen as defined in claim 2, wherein the top screen deck comprises a first top screen section, a second top screen section, and a third top screen section, the first top screen section adjacent to the second top screen section, the second top screen section adjacent to the third top screen section, the first, second, and third top screen sections forming a substantially continuous screening surface extending from the top receiving end to the top discharge end, the third top screen section coupled to the frame in a horizontal orientation, the second top screen section inclined a first angle to and extending upward and away from the third top screen section, the first top screen section inclined at a second angle from the horizontal and extending upward and away from the second top screen section, the second angle being equal to or greater than the first angle.

6. The screen as defined in claim 5, wherein the middle screen deck comprises a first middle screen section, a second middle screen section, and a third middle screen section, the first middle screen section adjacent to the second middle screen section, the second middle screen section adjacent to the third middle screen section, the first, second, and third middle screen sections forming a substantially continuous screening surface extending from the middle receiving end to the middle discharge end, the third middle screen section coupled to the frame in a horizontal orientation, the second middle screen section inclined at a third angle to and extending upward and away from the third middle screen section, the first middle screen section inclined at a fourth angle from the horizontal and extending upward and away from the second middle screen section, the forth angle being equal to or greater than the third angle, the first middle screen section mounted in substantially vertical alignment with the first top screen section, the second middle screen section mounted in substantial vertical alignment with the second top screen section, the third middle screen section mounted in substantial vertical alignment with the third top screen section, the second angle being equal to or greater than the fourth angle and the first angle being equal to or greater than the third angle.

7. The screen as defined in claim 6, further comprising a lower screen deck comprising one lower screen section, the lower screen deck having a lower receiving end and a lower discharge end, the lower screen deck coupled to the screen box orientated horizontally and positioned below the middle screen deck and in substantial vertical alignment with the top and middle screen decks, the lower screen deck having openings of a predetermined size smaller than that of the second screen deck for the separation of particulate material there through.

8. The screen as defined in claim 7, wherein the first, second and third top screen sections each comprises a frame and a first screen medium, the first screen medium supported by the frame, the first screen medium having openings of a predetermined size, the first, second and third middle screen sections each comprises a frame and a second screen medium, the second screen medium supported by the frame, the second screen medium having openings of a predetermined size smaller than the first screen medium, the lower screen section comprises a frame and a third screen medium, the third screen medium supported by the frame, the third screen medium having openings of a predetermined size smaller than the second screen medium.

9. The screen as defined in claim 7, wherein the first, second and third top screen sections each comprises a frame and a first screen medium, the first screen medium supported by the frame, the first screen medium having openings of a predetermined size which progressively decrease in size from the first top screen section to the third top screen section, the first, second and third middle screen sections each comprises a frame and a second screen medium, the second screen medium supported by the frame, the second screen medium having openings of a predetermined size smaller than the first screen medium which progressively decrease in size from the first middle screen section to the third middle screen section, the lower screen section comprises a frame and a third screen medium, the third screen medium supported by the frame, the third screen medium having openings of a predetermined size smaller than the second screen medium which progressively decrease in size from the lower receiving end to the lower discharge end.

10. The screen as defined in claim 7, wherein the first, second and third top screen sections each comprises a frame and a first screen medium, the first screen medium supported by the frame, the first screen medium having openings of a predetermined size which progressively increase in size from the first top screen section to the third top screen section, the first, second and third middle screen sections each comprises a frame and a second screen medium, the second screen medium supported by the frame, the second screen medium having openings of a predetermined size smaller than the first screen medium which progressively increase in size from the first middle screen section to the third middle screen section, the lower screen section comprises a frame and a third screen medium, the third screen medium supported by the frame, the third screen medium having openings of a predetermined size smaller than the second screen medium which progressively increase in size from the receiving end to the discharge end.

11. The screen as defined in claim 10, wherein the screening medium is selected from the group consisting woven wire cloth and perforated plate.

12. The screen as defined in claim 1, wherein the top screen deck further comprises a feed box coupled to the top screen section at the top receiving end, the feed box comprising a plate having a plurality of plate openings of the same predetermined size as the top screen deck, the feed box plate able to better resist the impact of particulate matter thereon.

13. The screen as defined in claim 1, further comprising at least one second screen deck having a receiving end and a discharge end, the at least one second screen deck comprising at least one screen section, the at least one second screen deck having openings of a predetermined size smaller than that of the top screen deck for the separation of particulate material there through, the top and at least one second screen deck coupled to the screen box in spaced apart relationship, at least one screen section proximate the discharge end of the second screen deck orientated horizontally and positioned below the top discharge end and in substantial vertical alignment with the first screen deck, wherein the top and at least one second screen deck having openings of a predetermined size successively smaller than the screen deck above.

14. A screen for separating particulate material comprising:

an upper screen deck to separate larger size particulate material from smaller size particulate material there through, the upper screen deck having a frame of spaced apart members having screening media laid thereon, the upper screen deck having an upper receiving end and an upper discharge end, the upper receiving end being inclined in a first upwardly extending position, the upper discharge end in a horizontal orientation, the screening material comprising a plurality of openings of predetermined size to permit the passage of particulate material smaller than the openings;

and wherein the upper screen deck further comprises a feed box coupled to the upper receiving end, the feed box comprising a plate having a plurality of plate openings of the same predetermined size as the respective screening media, the feed box plate able to better resist the impact of particulate matter thereon.

15. The screen of claim 14, further comprising a vibrating mechanism to impart vibratory motion to the upper screen deck to facilitate the passage of the material from the receiving end to the discharge end separating the smaller material from the larger material through the screening media openings.

16. The screen of claim 15, further comprising:

one or more lower screen decks to separate progressively smaller particulate material, the one or more lower screen decks having a frame of spaced apart member, having screening media laid thereon, the one or more lower screen decks having a lower receiving end and a lower discharge end, the one or more lower screen decks in substantial vertical alignment and below the upper screen deck, the receiving ends and discharge ends of each screen deck being in substantial alignment, with one or more lower screen decks adjacent the upper screen deck having the lower receiving end being inclined to the discharge end, the discharge end being in a horizontal orientation.

17. The screen as defined in claim 16, wherein at least one receiving end being adjustable to a predetermined inclined position.

18. The screen as defined in claim 14, wherein the screening medium is selected from the group consisting of woven wire cloth and perforated plate.

19. A screen for separating particulate material comprising:

a screen box;

at least two screen decks each having a receiving end and a discharge end, at least one of the at least two screen decks having an inclined receiving end and a horizontal discharge end, the at least two screen decks mounted in and forming a part of the screen box, the at least two screen decks in substantial vertical alignment with each other with corresponding receiving ends and discharge ends in substantial vertical alignment, the at least one screen deck with the inclined receiving end orientated above the other at least two screen decks, each screen deck comprising a frame and a screen medium, the screen medium supported by the frame, the screen medium having openings of a predetermined size, the predetermined size being progressively larger for each screen deck above a lower screen deck for the separation of particulate material there through; and a vibrating mechanism coupled to the screen box to impart a common vibratory movement to the at least two screen decks.

* * * * *

UNITED STATES PATENT AND TRADEMARK OFFICE

CERTIFICATE OF CORRECTION

PATENT NO. : 6,889,846 B2
DATED : May 10, 2005
INVENTOR(S) : Olsen et al.

It is certified that error appears in the above-identified patent and that said Letters Patent is hereby corrected as shown below:

Column 11,
Line 10, "separation, of" should read -- separation of --.
Line 60, "inclined a first" should read -- inclined at a first --.

Column 13,
Lines 16-17, "consisting woven wire" should read -- consisting of a woven wire --.

Column 14,
Lines 15-16, "member, having" should read -- members having --.

Signed and Sealed this

Sixth Day of December, 2005

JON W. DUDAS
*Director of the United States Patent and Trademark Office*